US005329920A

United States Patent [19]

Brazier

[11] Patent Number: 5,329,920

[45] Date of Patent: Jul. 19, 1994

[54] WOOD BURNING BOILER

[76] Inventor: Dennis Brazier, Rte. 1 - Box 80, Greenbush, Minn. 56726

[21] Appl. No.: 29,934

[22] Filed: Mar. 5, 1993

Related U.S. Application Data

[63] Continuation of Ser. No. 799,975, Nov. 29, 1991, abandoned.

[51] Int. Cl.[5] ..... F23M 7/00; F24H 1/00

[52] U.S. Cl. ..... 126/344; 126/193; 126/190; 122/13.1; 122/15

[58] Field of Search ..... 126/344, 190, 198, 58 R, 126/193, 101, 116 R, 110 R, 60, 65, 67, 83; 122/13.1, 6 A, 15, 50, 68, 58 R, 73, 74, 96, 62, 107, 110; 110/234, 173 R, 173 A, 173 B, 173 C, 181

[56] References Cited

U.S. PATENT DOCUMENTS

| | | | |
|---|---|---|---|
| 393,336 | 11/1888 | Kearney et al. | 122/68 |
| 1,531,884 | 3/1925 | Soderlin | 126/307 R |
| 1,934,438 | 11/1933 | Macchi | 110/173 B |
| 4,497,262 | 2/1985 | Nordine | 122/15 X |
| 4,542,734 | 9/1985 | Trent et al. | 126/116 R X |
| 4,724,798 | 2/1988 | Alspaugh | 126/101 X |
| 4,926,797 | 3/1990 | Butler | 122/15 |

*Primary Examiner*—Carl D. Price
*Attorney, Agent, or Firm*—Douglas L. Tschida

[57] ABSTRACT

An outdoor, self-contained wood fueled furnace. The furnace includes a non-warping, laminated sheet metal door; a rear exiting flue with water discharge means; and a baffled, heat exchanger which surrounds the firebox. The door, particularly, includes an external panel which is secured with a single pin to a crossbroken first panel. An insulator is secured between the first panel and a second interior panel, and the first and second panels are riveted to each other.

14 Claims, 3 Drawing Sheets

WOOD BURNING BOILER

This is a continuation of application Ser. No. 07/799,975 filed Nov. 29, 1991 abandoned.

BACKGROUND OF THE INVENTION

The present invention relates to wood or coal fueled heating systems and, in particular, to a self-contained furnace which mounts externally of the structure or premises being heated.

With increasing heating fuel costs for gas and petroleum products, alternatively fueled heating systems have experienced a resurgence in popularity. Wood and coal fired stoves, boilers and furnaces are increasingly being used as the primary or as a supplemental heat source. This is especially true in the northern-tier states where alternative, low-cost fuel supplies are available and winters tend to be long and cold.

Many of these stoves mount within the structure being heated. That is, the heating appliance is typically contained within a utility room or finished room of the dwelling. Either radiant heat is obtained or an intermediate heat exchange carrier or media is heated and conducted about the premises.

Unfortunately, the increased use of fuels that produce relatively large amounts of creosote and improper stove and flue maintenance has resulted in increased numbers of related fires and resultant increased insurance premiums. Many manufacturers of stoves and furnaces intended for use as primary heating systems, therefore, now construct there stoves as self-contained assemblies. These assemblies are mounted external to the premises to be heated. The risk of fire and smoke damage to the premises is thereby reduced.

With the removal of the firebox from the premises, larger fireboxes become more practical, along with longer burn times between each recharging or refueling. Consequently and depending upon the fuel, burn times of one to multiple days can be obtained between each re-charging of the stove. Stoves may now also be used over a longer heating season, since the residual radiant heat does not overheat the premises during milder fall or spring days. As these stoves are also made to burn more efficiently, the flue temperatures have been reduced.

With reduced flue temperatures, however, increased amounts of creosote and water vapor are created which can significantly reduce the life of the firebox, especially where a top mount flue is provided. That is, large amounts of moisture accumulate as part of the combustion process and can amount from one to many quarts a day. This water accumulates in the ash to form an acidic lye compound which corrodes away the firebox in a matter of months.

An additional problem effecting the cost of the stove and operational safety can develop at the fire door. Depending upon the stove construction, warpage can occur in the door during the normal cycling of the stove. The warpage may be significant or not and may even permanently effect the door. In all cases, however, warpage tends to create unintended drafts and unregulated burning. A non-warping door construction is therefore desired.

With the foregoing considerations in mind, applicant has developed an improved self-contained wood or coal fueled furnace.

SUMMARY OF THE INVENTION

It is accordingly a primary object of the present invention to provide a self-contained wood or coal fired furnace.

It is a further object of the invention to provide a furnace firebox including a laminated, non-warping door.

It is a further object of the invention to provide a firebox including a side wall exiting flue and means for preventing the collection of water within the firebox.

It is a further object of the invention to provide a firebox surrounded by a heat exchanger and a contained heat transfer medium and wherein channel ways are formed in the firebox and through which the flue gasses are conducted to extract heat to the transfer medium, as the channelways baffle the combustion gases to optimally burn all combustibles.

It is a still further object of the invention to provide a composite boiler assembly including a non-warping laminated firebox door, a water extracting flue and baffled conduits which direct combustion gases and a circulated heat transfer medium.

Various of the foregoing objects, advantages and distinctions of the invention are particularly obtained in one construction wherein a double walled furnace is mounted within a steel frame, pad mounted enclosure. The furnace includes a central firebox which is surrounded by a heat exchanger. Intermediate insulation insulates a liquid heat transfer medium and the furnace to maximize heat transfer to the medium. Associated controls regulate the burning characteristics of the furnace.

The furnace door extends from the enclosure and is hinged to the firebox. The door is constructed of a plurality of laminated, sheet metal panels which are arranged and insulated from one another to permit thermal flexing of the internal door panels, without transferring heat to an external door panel. The external panel is secured to a crossbroken middle panel which is supported at a center truss pin to the external door panel. An innermost panel, otherwise, is separately retained to the middle panel via a minimal number of fasteners. An insulation barrier mounts between the middle and internal panels.

An exhaust gas flue extends from a side or rear wall of the firebox through a surrounding heat exchanger containing a water based heat transfer medium. A drip-tee having a waste port directs water formed within the flue away from the firebox.

The heat exchanger includes a plurality of hollow, horizontal conduits or baffles which are directed through the firebox and above the fire and wherethrough the heat transfer medium is channeled to extract heat. An additional full width, planar channelway projects from a top wall of the firebox intermediate the space between the fire and the flue to further recirculate flue gas and extract heat from the exhaust gases.

Still other objects, advantages and distinctions of the invention will become more apparent from the following description with respect to the appended drawings. To the extent various modifications and improvements have been considered, they are described as appropriate. The following description should not however be interpreted in limitation of the invention, which rather should be interpreted within the spirit and scope of the following presented claims.

DESCRIPTION OF THE PREFERRED EMBODIMENT

Figure 1:
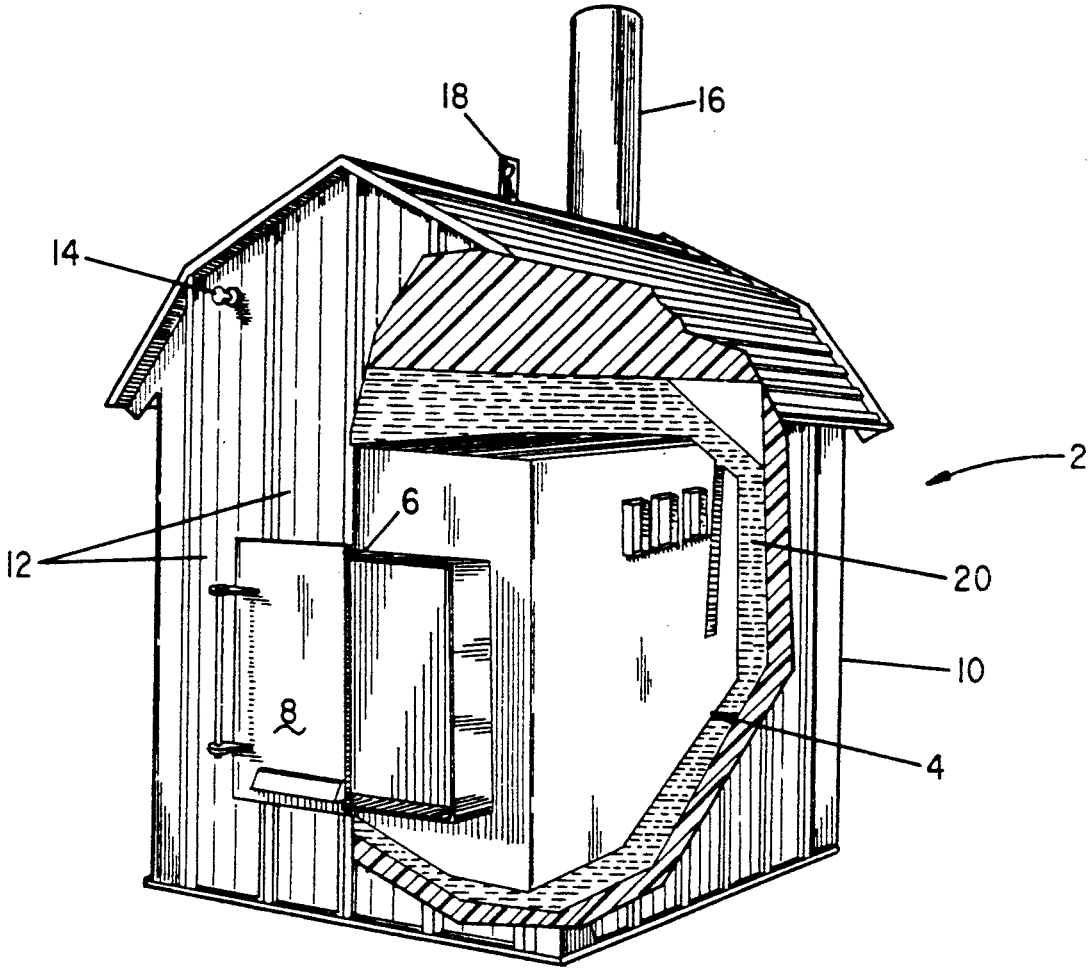
FIG. 1 is a perspective drawing shown in partial cutaway of a self-contained boiler construction of the present invention.

Referring to FIG. 1, a perspective drawing is shown in partial cutaway of the improved wood or coal fired furnace 2 of the present invention. The furnace is normally mounted a short distance from a premises to be heated. The furnace 2 comprises a multi-walled, wood or coal fueled stove 4. A central firebox is surrounded by a heat exchanger containing a water based heat transfer medium. Alternatively, an air-to-air exchanger or other types of heat exchangers could be coupled to the firebox.

Attendant conduits or piping are mounted below grade and convey the water or a water-glycol mixture between the furnace 2 and the heated premises. Glycol is added to prevent freeze-up, should circulation be interrupted. A circulator motor mounted within the premises, conveys the water based heat transfer medium between the two structures. A temperature controller within the premises typically regulates liquid flow via controlled gate valves. This controller may or may not be coupled to a separate controller at the furnace.

Extraneous pathways may also be provided in the conduit system to bleed-off undesired heat during mild heating days. Such pathways permit continuous circulation of the coolant, which if otherwise allowed to remain stagnant, could freeze below grade or otherwise cause a bursting of the conduits.

A separate temperature controller ( not shown ) at the furnace 2, otherwise, monitors the water based transfer medium to maintain a temperature of approximately 170 degrees. A motorized damper control (not shown) is coupled to a damper 48 (reference FIG. 3) to regulate combustion air to the firebox. Proper control requires an airtight or relatively constant seal 6 at the juncture between the access door 8 and the firebox. Temporary or permanent warpage of the door 8, which can occur with relatively hot fires, can upset the regulation.

Any door mounted in close association to the fire, such as a cast iron door, tends to expand and contract in harmony with the firebox and permanent warpage does not normally occur. Cast iron doors, however, are relatively costly. Permitting the door to cycle with the firebox temperature also compromises furnace safety, especially to the unwary fire tender or passer by. Use of a cast door in an external setting further exposes the door to rusting, which occurs with the cycling of the stove in a humid environment.

The foregoing deficiencies suggest use of a formed sheet metal door. However, unless such a door is allowed to cycle with firebox temperatures, a separate safety or cover door is typically required. Sheet metal doors are also prone to permanent warpage. Although warpage may not occur with smaller stoves, larger furnaces 2 of the present type, which burn for an entire day or several days between chargings, are more susceptible to warpage. An improved, laminated door construction is thus provided with the furnace 2 of FIG. 1. Other improvements are also provided which are discussed in greater detail with respect to FIGS. 1 to 3.

Before addressing the particular improvements of the furnace assembly 2, the stove 4 is integrally mounted within a surrounding enclosure 10. The enclosure 10 is fabricated from painted steel panels 12 such as are commonly used in pole barn construction. In normal use, the furnace 2 can either be mounted on a pad or a prepared sand or gravel base.

A night light 14 is mounted to the front of the enclosure 10 to facilitate tending during low light conditions. A flue 16, otherwise, projects through the rear wall of the enclosure, along with a lifting or transport flange 18. A separate weather cap is not typically required at the flue 16 and the reasons for which will become more apparent.

Otherwise, the interior space of the enclosure 10 is filled with an expandable urethane foam 20. Once applied, the foam expands to completely fill the enclosure interior and conforms to the mounted stove 4. Because a double-walled stove construction is used and wherein a liquid heat exchanger surrounds the firebox, the foam 20 can directly contact the heat exchanger and the temperature of which does not exceed the nominal fire rating of the foam.

Figure 2:
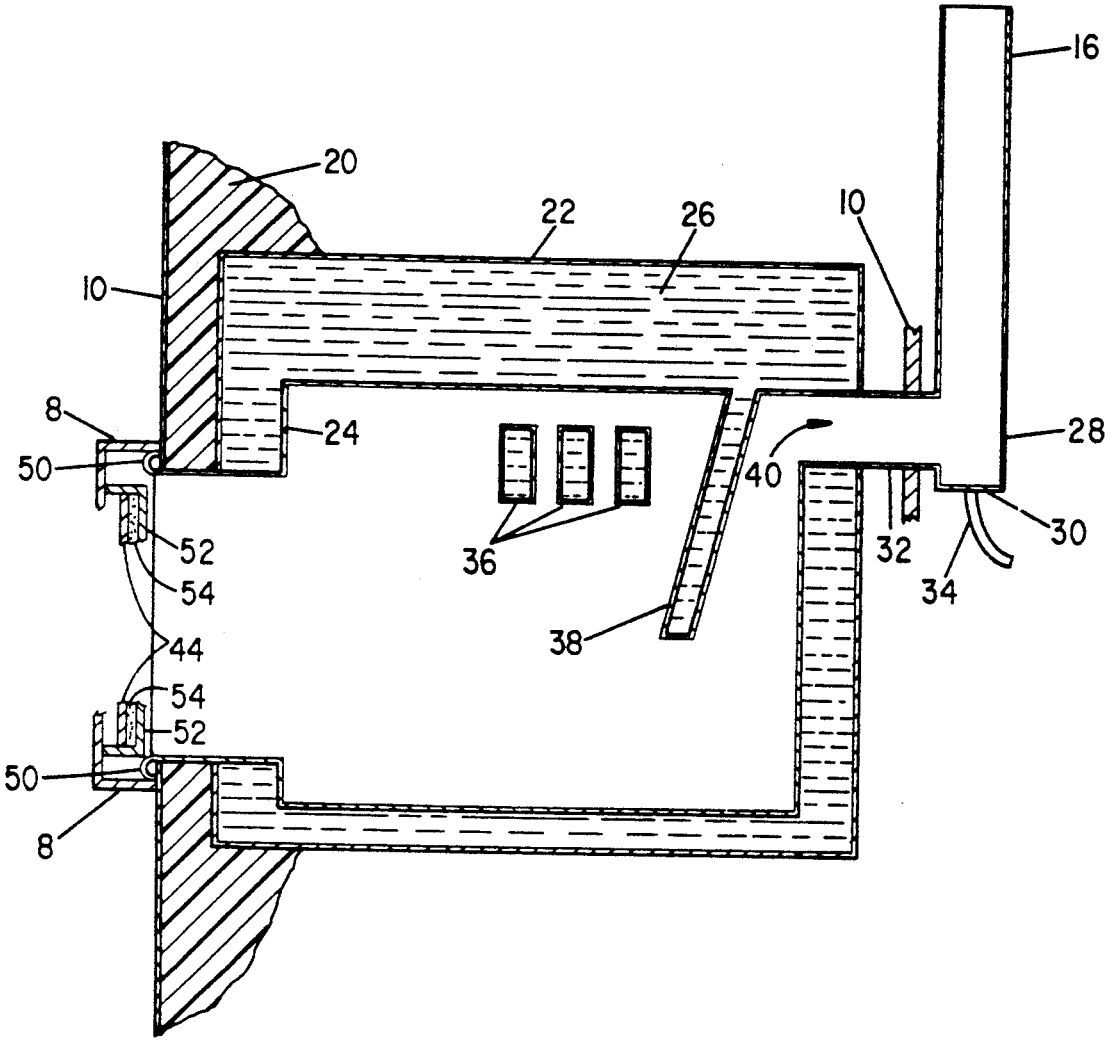
FIG. 2 is an elevation drawing shown in cross section of the firebox and surrounding water chamber and wherefrom details of the baffling and flue mounting are apparent.

With attention to FIG. 2, more of the internal details of the stove construction and the mounting between the stove 4 and enclosure 10 are apparent. The stove 4, as mentioned, is particularly constructed in a double-walled configuration. That is, a water-tight, external housing 22 surrounds an internal water-tight firebox 24. The cavity 26 between the housings 22,24 contains a water based liquid heat transfer medium which is piped through the structure (not shown) being heated. The walls of the housings 22 and 24 are respectively constructed of seven gauge and ¼ inch steel sheet stock. A firebrick liner may be provided at the bottom of the firebox 24, if the heat exchanger housing 22 doesn't surround the bottom of the firebox 24. Ash removal and combustion air occur through the front access door 8.

The flue 16 projects horizontally through a rear wall of the firebox 24, heat exchanger 22 and enclosure 10 to a T-coupler 28, where the flue is vertically redirected upward. The bottom 30 of the T-coupler 28 is disposed below the horizontal flue section 32. A drain port 34 is positioned at a low point of the coupler 28 and from which a length of hosing or conduit 36 may extend to bleed-off water which is formed during combusion or which might enter the flue 16 during rain or snow conditions.

Nominal quantities from a pint to a gallon or more of liquid can be created on a daily basis with the present furnace 4. If the liquid is allowed to return to the firebox 24 and mix with the ash, the firebox 24 can prematurely corrode through within a matter of one to two years. Appreciating the sealed construction of the furnace 2, the facility to drain combustion water away from the stove 4 is therefore especially critical.

Also formed into the walls of the firebox 24 are a plurality of baffles. Three horizontal baffles 36 are provided which extend through the sidewalls of the firebox 24 and which overlay the fire. The heat transfer medium circulates thorugh these baffles.

An additional planar baffle 38 angulates downward and inward between the exhaust port 40 of the flue 16 and the interior of the firebox 24. Prior to exiting the firebox 24, flue gases are normally circulated about the horizontal and planar baffles 36 and 38 to enhance the burning of all combustible particulates and gases and to extract optimal heat from the gases prior to exiting the flue. The overall efficiency of the furnace per charging is thereby enhanced.

Figure 3:
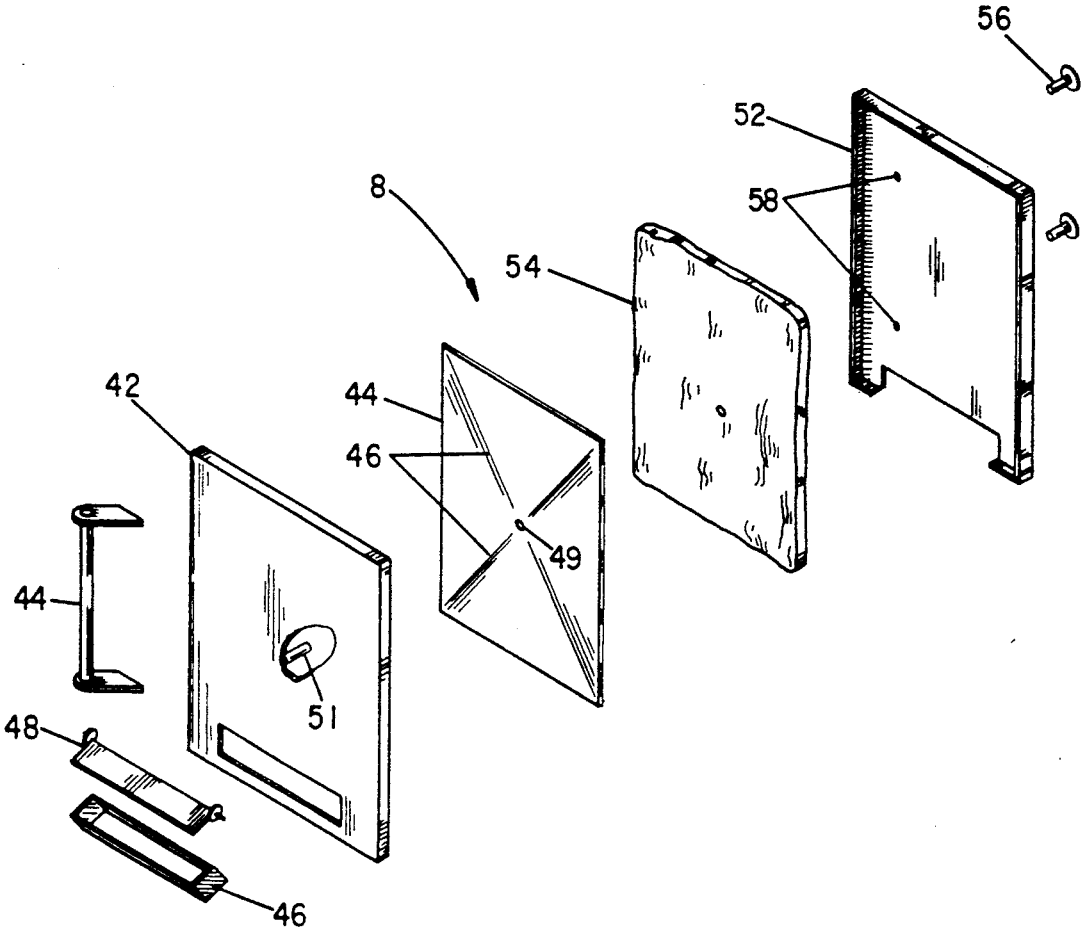
FIG. 3 is a perspective drawing shown in exploded assembly of the laminated door construction.

With attention next directed to FIG. 3, a detailed perspective drawing is shown in exploded assembly of the laminated access door 8. The door 8 is particularly constructed of a seven gauge external door panel 42, which includes an access handle 44 and an associated combustion air port 46 and pivotally mounted damper 48. The internal periphery of the door contains a fireproof seal 50 (reference FIG. 2). Upon closing the door 8, the seal 50 contacts the periphery of the access port to provide an airtight seal to the firebox 24.

Coupled to the exterior panel 42 is a middle panel 44. The panel 44 is formed of a thinner gauge sheet metal and includes a pair of diagonal or crossbroken bends 46 which extend diagonally between the corners. A center hole 48 at the intersection of the bends 46 receives a truss pin 51 (shown in cutaway) which extends from an inner surface of the external panel 42. Upon mounting the center panel 44 over the truss pin 51 at the center hole 49, the truss pin 51 is flattened over an intervening washer (not shown). The center panel 44 is thereby riveted to the external door panel, but in a rather loose mounting.

The center panel 44 partially stabilizes the external panel 42, but more importantly, thermally insulates the external panel 42 from the relatively hot temperatures of the firebox 24 via the intervening air. A minimal number of connections between the middle panel 44 and external panel 42 minimize heat transfer and permit maximum flexing and thereby prevent door warpage.

Mounted between the aft surface of the middle panel 44 and an interior door panel 52 is a layer of a woven, ceramic impregnated insulator 54. The material is approximately ⅜" thick.

The door panel 52, otherwise, is formed to encase the insulator 54 and the middle panel 44 without being permanently connected to the external door panel 42. The inner and middle door panels 52, 44 are secured to one another with a pair of rivet fasteners 56 which are welded to the aft surface of panel 44 and extend through a pair of holes 58 provided on one side of panel 52, where they are flattened. Heat transfer and any potential warpage of the external door panel 42 is thus further prevented via the insulator 54 and the limited number of direct couplings between the panels 44, 52. In normal use, the foregoing laminated construction assures that the external panel 42 remains cool to the touch, thus satisfying safety concerns along with the equally important cost and corrosion concerns earlier mentioned.

Singularly and in combination, the foregoing door 8, flue 16 and baffles 36 and 38 provide a long-lived energy efficient stove 4. Although described with respect to a boiler configuration, it is to be appreciated that the improvements may also be utilized with a forced air furnace. Similarly, the individual improvements can be singularly incorporated into other stove constructions.

While the invention has accordingly been described with respect to its presently preferred construction and various modifications and improvements thereto, it is to be appreciated still other constructions may suggest themselves to those skilled in the art. Accordingly, the following claims should be interpreted to include all those equivalent embodiments within the spirit and scope thereof.

What is claimed is:

1. Heating apparatus comprising:

a) stove means having a plurality of side, top and bottom walls, wherein said walls enclose a first cavity and wherein at least one of said walls included an access port to the first cavity and at least one of said walls includes an exhaust port to the first cavity, for containing a fire within the first cavity;

b) heat exchange means having a plurality of walls secured to and surrounding said stove means to define a second cavity for containing a thermal transfer medium to contact the walls of said stove means without communicating with said access and exhaust ports;

c) door means for covering said access port and comprising 1) an external metal panel, 2) a first metal panel, wherein portions of said first and external panels subtend an air space between the first and external panels, 3) a second metal panel, 4) an insulator layer mounted between the first and second panels, 5) first fastener means for restraining said first panel to said external panel, 6) second fastener means offset from said first fastener means for restraining said first panel to said second panel, and 7) wherein at least one of said first and second fastener means comprises a pin which projects from one of the external or first panels and loosely extends through an aperture at the other of the first or second panels, such that the other of the first and second panels flexes along said pin with thermal changes in said first cavity, whereby said external, first and second panels are substantially thermally insulated from one another and said first and second panels are able to flex independent of one another without transfering panel flexion to cause warpage of the external panel; and d) flue means communicating with said exhaust port for exhausting combustion gases.

2. Apparatus as set forth in claim 1 wherein said first panel is rectangular and includes first and second bends, which intersect, and which extend between opposite diagonal corners of said first panel, wherein a first pin extends from the external panel through an aperture at the intersection of the bends, and wherein second and third pins extend from the first panel through a pair of apertures at the second panel.

3. Apparatus as set forth in claim 2 wherein peripheral edges of said second panel subtend said first panel.

4. Apparatus as set forth in claim 2 including a multi-walled, steel frame enclosure mounted to surround said heat exchange means, except in the region of said door means and said flue means, and wherein a thermal insulator mounts between said enclosure and said heat exchange means.

5. Heating apparatus comprising:

a) stove means having a plurality of side, top and bottom walls, wherein said walls enclose a first cavity and wherein at least one of said walls includes an acess port to the first cavity and at least one of said walls includes an exhaust port to the first cavity, for containing a fire within the first cavity;

b) heat exchange means having a plurality of walls secured to and surrounding said stove means to define a second cavity for containing a thermal transfer medium to contact the walls of said stove means without communicating with said access and exhaust ports;

c) door means for covering said access port and comprising 1) an external metal panel, 2) a first metal panel including first and second intersecting bends, 3) a first pin extending from the external panel and through a first aperture at an intersection of the bends panel and wherein the first panel subtends an air space between the first and external panels, 4) a second metal panel having second and third apertures, 5) an insulator layer mounted between the first and second panels, 6) second and third pins offset from said first pin and extending between the first and second panels through said second and third apertures, and 7) wherein at least one of the first and second panels flexes along said first, second or third pins with thermal changes in said first cavity, whereby said external, first and second panels are substantially thermally insulated from one another and said first and second panels are able to flex independent of one another without transferring panel flexion to cause warpage of the external panel; and d) flue means communicating with said exhaust port for exhausting combustion gases.

6. Apparatus as set forth in claim 5 wherein peripheral edges of said second panel subtend said first panel.

7. Apparatus as set forth in claim 5 including a multi-walled, steel frame enclosure mounted to surround said heat exchange means, except in the region of said door means and said flue means, and wherein a thermal insulator mounts between said enclosure and said heat exchange means.

8. Heating apparatus comprising:

a) stove means having a plurality of side, top and bottom walls, wherein said walls enclose a first cavity and wherein at least one of said walls includes an access port to the first cavity and at least one of said walls includes an exhaust port to the first cavity, for containing a fire within the first cavity, wherein a plurality of conduits extend through the first cavity above a fire space, wherein each conduit has a bore exposed through one of said side walls, and wherein the top wall includes a recess which extends into the first cavity in a space between said conduits and the exhaust port;

b) heat exchange means having a plurality of walls secured to and surrounding said stove means to define a second cavity for containing a thermal medium to contact the walls of said stove means and to flow through the bore of each of said conduits without communicating with said access and exhaust ports;

c) door means for covering said access port and comprising 1) an external metal panel, 2) a first metal panel, 3) a second metal panel, 4) means for thermally insulating said external panel from said first panel and the first panel from the second panel, 5) first fastener means for restraining said first panel to said external panel, 6) second fastener means offset from said first fastener means for restraining said first panel to said second panel, and 7) wherein at least one of said first and second fastener means comprises a pin which projects from one of the external or first panels and loosely extends through an aperture at the other of the first or second panels such that the other of the first an second panels flexes along said pin with thermal changes in said first cavity, whereby said external, first and second panels are substantially thermally insulated from one another and said first and second panels are able to flex independent of one another without transfering panel flexion to cause warpage of the external panel; and d) flue means communicating with said exhaust port for exhausting combustion gases and including means for removing liquids formed within said flue means.

9. Apparatus as set forth in claim 8 wherein said first panel includes a plurality of bends.

10. Apparatus as set forth in claim 9 wherein said first panel is rectangular and includes first and second bends which extend between opposite diagonal corners of said first panel and wherein a single pin fastener couples said first panel to said external panel at an intersection of the first and second bends.

11. Apparatus as set forth in claim 8 wherein the liquid removal means comprises a T-shaped coupler having a liquid discharge portion which mounts below the exhaust port.

12. Apparatus as set forth in claim 8 including damper means coupled to said door means for controllably admitting combustion air to said first cavity.

13. Apparatus as set forth in claim 8 including a multi-walled, steel frame enclosure mounted to surround said heat exchange means, except in the region of said door means and said flue means, and wherein a thermal insulator mounts between said enclosure and said heat exchange means.

14. Apparats as set forth in claim 8 wherein said thermal transfer medium comprises water.

* * * * *